US006434922B2

(12) United States Patent
Dalerba

(10) Patent No.: US 6,434,922 B2
(45) Date of Patent: Aug. 20, 2002

(54) TRACK SLIDING FACILITATING METHOD AND DEVICE FOR A WIRE STRANDING MACHINE

(76) Inventor: Angelo Dalerba, Via F.Ili Cervi 1, 20060 Bussero (IT)

( * ) Notice: Subject to any disclaimer, the term of this patent is extended or adjusted under 35 U.S.C. 154(b) by 0 days.

(21) Appl. No.: 09/734,915

(22) Filed: Dec. 13, 2000

(51) Int. Cl.[7] ..... H01B 13/02
(52) U.S. Cl. ..... 57/311; 384/12; 57/58.36
(58) Field of Search ..... 384/12; 57/311, 57/58.36

(56) References Cited

U.S. PATENT DOCUMENTS

| | | | | |
|---|---|---|---|---|
| 3,484,064 A | * | 12/1969 | Koenig, III | 248/13 |
| 4,744,675 A | * | 5/1988 | Sakino et al. | 384/12 |
| 5,330,270 A | * | 7/1994 | Ohmori | 384/8 |

FOREIGN PATENT DOCUMENTS

| | | |
|---|---|---|
| DE | 23 38 321 | 2/1975 |
| EP | 0 463 864 | 1/1992 |
| FR | 1 492 109 | 11/1967 |

* cited by examiner

*Primary Examiner*—Andy Falik
(74) *Attorney, Agent, or Firm*—Guido Modiano; Albert Josif; Daniel O'Byrne

(57) ABSTRACT

A method and a device for facilitating the sliding, along a track, of an element having a predominant axial dimension subjected to an intense force pressing it against the track, particularly for facilitating the sliding of a wire subjected to stranding in stranding machines. The method consists in interposing between the element and the track a pressurized fluid which contrasts the force that presses the element against the track. In this way, the sliding friction of the element on the track is reduced and it is possible to reduce the force to be applied to the element in order to achieve its advancement along the track.

20 Claims, 2 Drawing Sheets

TRACK SLIDING FACILITATING METHOD AND DEVICE FOR A WIRE STRANDING MACHINE

BACKGROUND OF THE INVENTION

The present invention relates to a method and a device for facilitating the sliding, along a track, of an element having a predominant axial dimension subjected to an intense force pressing it against the track, particularly for facilitating the sliding of a wire subjected to stranding in stranding machines or the like.

It is known that in many machines used to perform the stranding of wires in general or of conducting wires for electrical systems or for telecommunications, a wire is guided along a stranding arc, known as bow, which is fixed at its ends to two symmetrical flyers, each of which is fixed to a shaft of a pair of coaxial shafts which are actuated, rigidly with respect to each other, with a rotary motion about their common axis.

In practice, during the stranding operation, a wire moves along the stranding bow while the bow is actuated with a rotary motion about an axis which passes through the ends of the bow. The advancement of the wire along the stranding bow is produced by a traction force which is applied to the wire downstream of the stranding bow along the wire advancement direction.

During the rotation of the stranding bow, the wire that advances along the bow, due to the centrifugal force produced by the rotation of the bow, is pressed against the side of the bow that is directed toward the rotation axis. On this side of the bow there is a metal sliding track which has a reduced friction coefficient with respect to the wire that must advance along it.

The productivity of these machines is a function of the rotation rate of the bow, which cannot exceed a certain limit which in turn is a function of the maximum traction that can be applied to the wire downstream of the stranding bow. As the rotation rate of the stranding bow increases, the centrifugal force increases the pressure applied by the wire to the sliding track and accordingly the friction force that contrasts the advancement of the wire along the bow increases. This increase in the friction force requires, in order to achieve the advancement of the wire, an increase in the traction applied to the wire downstream of the stranding bow, which however cannot exceed a maximum value if one wishes to avoid causing damage or modifications of the wire that are not compatible with its subsequent use. For these reasons, stranding machines, particularly machines for stranding signal conductors for control and communication, i.e., wires with a copper core covered with an insulating layer having a low mechanical strength, currently cannot reach high rotation rates of the stranding bow and therefore have rather low productivities.

Merely by way of example, in a conventional stranding machine for stranding telecommunications cables, if one wishes to limit the drawing traction that can be applied to the cable, $T_{max}$, to the 30 N required to preserve the electrical and insulation characteristics of the cable that are currently required, assuming that the portion of wire contained along the entire path of the bow has a mass $m=2\cdot10^{-2}$ kg, a friction coefficient $f_a=0.25$, an average radius of the rotation path of the bow R=0.225 m, and requiring the sliding friction force along the bow to be lower than, or equal to, the maximum applicable traction, one obtains:

$$T_{max}=30N\leqq f_a\cdot m\cdot R\cdot(2\pi n)^2=0.25\cdot2\cdot10^{-2}\cdot0.225\cdot40\ n^2$$

where n=rotation rate of the bow in revolutions per second from which:

$n^2\geqq666$ and therefore $n\geqq26$ revolutions/second=1,550 rpm i.e., an excessively low speed with respect to modern production requirements.

SUMMARY OF THE INVENTION

The aim of the present invention is to solve the above-noted problem, by providing a method and a device which allow to facilitate the sliding, along a track, of an element having a predominant axial dimension, or wire-like element, which is subjected to an intense force pressing it against the track, particularly for facilitating the sliding of a wire subjected to stranding in stranding machines or the like.

Within this aim, an object of the present invention is to provide a method and a device which, particularly in stranding machines, allow to increase the rotation rate of the stranding bow and therefore to increase the productivity of these machines.

Another object of the invention to provide a method and a device which, by facilitating the sliding of the wire along the track, allow to maintain the traction force, to be applied to the wire in order to produce its advancement, below the limit value in order to ensure high wire quality.

This aim and these and other objects which will become better apparent hereinafter are achieved by a method for facilitating the sliding, along a track, of an element having a predominant axial dimension subjected to an intense force pressing it against the track, particularly for facilitating the sliding of a wire subjected to stranding in stranding machines or the like, characterized in that it comprises the step of interposing between said element and said track a pressurized fluid which contrasts the force that presses said element against said track.

BRIEF DESCRIPTION OF THE DRAWINGS

Further characteristics and advantages of the invention will become better apparent from the following detailed description of a preferred but not exclusive embodiment of the method and the device according to the invention, illustrated by way of non-limitative example in the accompanying drawings, wherein.

DESCRIPTION OF THE PREFERRED EMBODIMENTS

Figure 1:
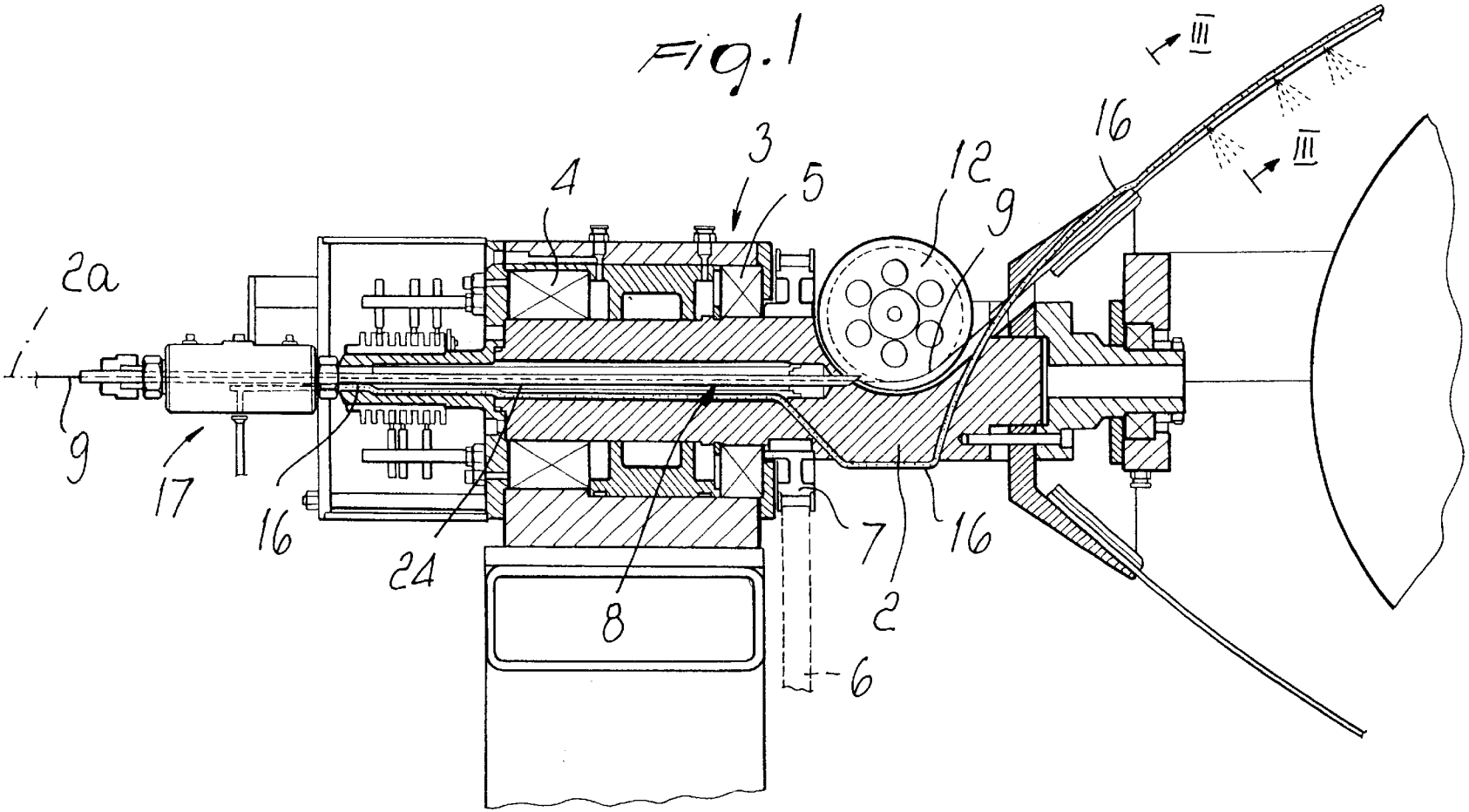
FIG. 1 is a schematic view of a stranding machine to which the device according to the invention has been applied.

For the sake of simplicity in description, the method and the device according to the invention are described hereinafter with reference to their preferred application to a stranding machine, such as the one of FIG. 1, of the type comprising a stranding bow 1, which is shown only partially and is fixed, at its ends, to a pair of coaxial hollow shafts, only one of which is shown in the figures and is designated by the reference numeral 2. The shaft 2 is supported, so that it can rotate about its own axis 2*a*, by a supporting structure 3, shown only partially in the figures, by means of bearings 4 and 5 and can be actuated with a rotary motion about its own axis 2*a* in a per se known manner, for example by means of a motor, not shown, which is connected by means of a belt or chain 6 to a pulley or pinion 7 which is keyed to the shaft 2.

The other hollow shaft, not shown, supports the other end of the bow 1 and is supported, so that it can rotate about its own axis, which coincides with the axis 2*a*, by the supporting structure 3.

In the illustrated embodiment, the shaft 2 is crossed, along part of its extension, by a coaxial passage 8 in order to allow the passage of the wire 9, or wire-like element, which is fed from outside.

The bow 1 is fixed, with one of its ends, to the shaft 2 and has, on its side directed toward the axis 2*a*, a sliding track 10 for the wire 9. Along the extension of the bow 1, on the side of the bow 1 that is directed toward the axis 2*a* there are provided U-bolts 11 which are mutually spaced and are meant to limit the separation of the wire 9 from the track 10 toward the axis 2*a* (as is necessary when no rotation is occurring).

The bow 1 can be made of carbon fiber and the track 10 can be made of aluminum or other metal having a low friction coefficient with respect to the rubber or insulating material that is extruded over the conductor, constituting the wire 9.

In the region where the shaft 2 is connected to the bow 1 there is a wheel 12 which is arranged so that its axis lies at right angles to the axis 2*a*. The wheel has a circumferential groove for the wire 9 which is arranged so that its bottom is tangent to the axis 2*a* in order to divert the wire 9, which enters the opposite end of the shaft 2 with respect to the bow 1, from the axis 2*a* to the bow 1.

The method according to the invention consists in interposing, between the wire 9 and the track 10, a pressurized fluid so as to contrast the compression of the wire 9 against the track 10, thus reducing the sliding friction of the wire 9 on the track 10.

More particularly, the track 10 is formed by a groove 13 which lies on the side of the bow 1 that is directed toward the axis 2*a*. During the rotation of the bow 1, centrifugal force pushes the wire 9 so that it makes contact with the sides of the groove 13, so as to close along the entire length of the bow 1 a channel 14 which is delimited, in cross-section, by the sides and the bottom of the groove 13.

The pressurized fluid, which according to requirements can be constituted simply by air or by air mixed with lubricants, is introduced in the channel 14 through the bottom of the groove 13.

The groove 13 can have a width which increases gradually from its bottom, so that it can be used for wires 9 having mutually different diameters (i.e., it can have a V-shaped or U-shaped cross-section).

The pressurized fluid can be introduced in the channel 14 on the bottom of the groove 13 through mutually spaced passages 15 or through a slot which runs continuously along the bow 1.

Conveniently, the pressurized fluid can be conveyed through the bottom of the groove 13 by providing a duct 16 which is fixed, as shown, to the side of the bow 1 that lies opposite the axis 2*a*, for example by means of said U-bolts 11, and is connected to the bottom of the groove 13 by means of holes or by means of a continuous milling to be performed preferably after applying the duct 16 to the bow 1 so as to achieve a high match between the holes formed in the duct 16 and the holes formed in the groove 13.

As an alternative, it is possible to provide bows such as 1 which already directly contain, in their body, appropriate ducts which are adjacent to the track 10, on the centerline that corresponds to the groove 13 (which has already been provided or is yet to be provided).

The pressure of the fluid introduced in the channel 14 is adjustable. If the force that it applies to the wire 9 is smaller than, or equal to, the centrifugal force that presses the wire 9 in the groove 13, one has in any case a reduction in the sliding friction of the wire 9 along the groove 13 which is proportional to the difference between the centrifugal force and the force generated by the fluid.

The pressure of the fluid introduced in the channel 14, which is the supply pressure and is therefore adjustable from outside, can also be such as to obtain, on the wire 9, a force which is greater than the force that presses the wire 9 in the groove 13. In this case, the fluid introduced in the channel 14 causes the separation of the wire 9 from the sides of the groove 13, forming a continuous lamina that is interposed between the mutual contact surfaces of the wire 9 and the groove 13, achieving an even greater reduction of the sliding friction of the wire 9 along the groove 13 (but at the cost of a higher consumption of pressurized fluid).

The duct 16 runs not only along the bow 1 but also inside the shaft 2, starting from a rotary coupling 17 which is connected to the end of the shaft 2 that lies opposite with respect to the bow 1.

Figure 2:
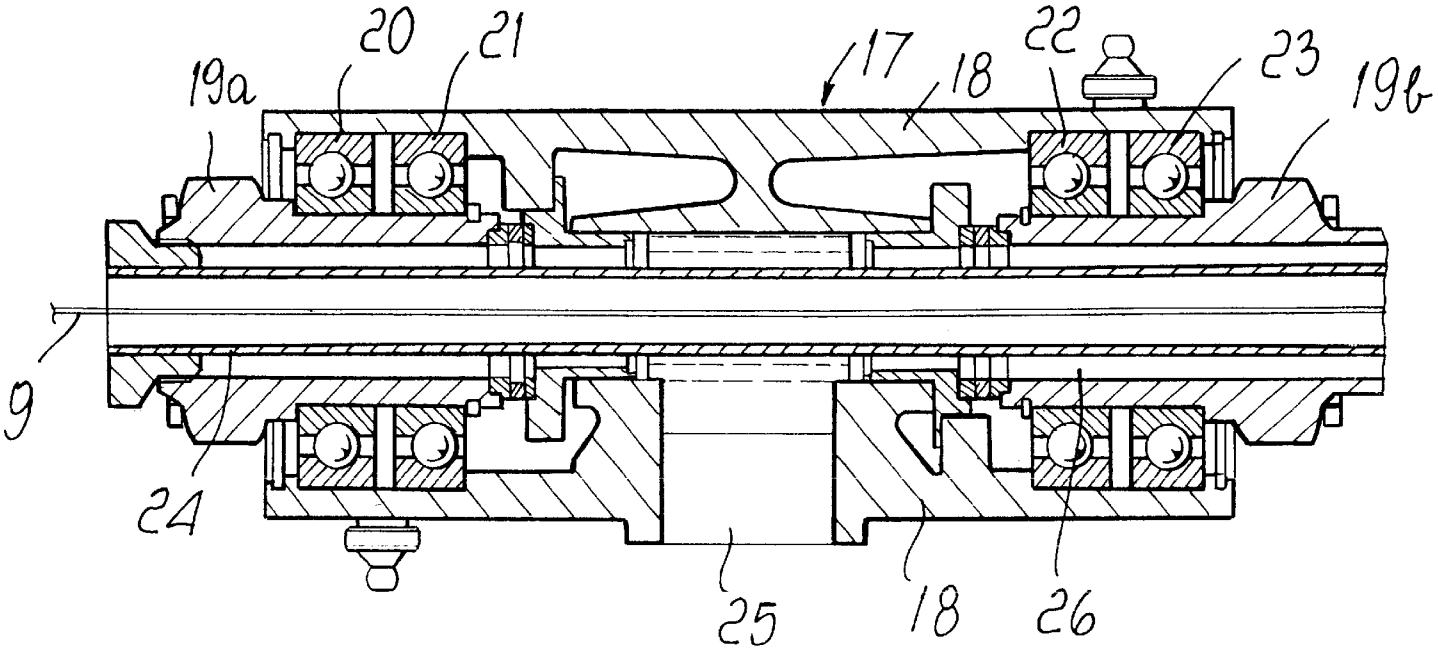
FIG. 2 is an enlarged-scale sectional view of a detail of FIG. 1.
Figure 3:
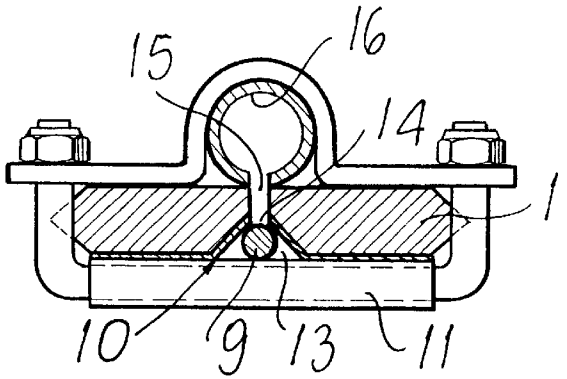
FIG. 3 is an enlarged-scale sectional view of a detail of FIG. 1, taken along the plane III—III.

More particularly, as shown in particular in FIG. 2, the rotary coupling 17 comprises an outer sleeve 18, which is fixed with respect to the ground and is connected to the fluid supply system, and inner tubular bodies 19*a* and 19*b* which are arranged coaxially inside the outer sleeve 18 and support it so that it can rotate about the common axis, which coincides with the axis 2*a*, by virtue of bearings 20, 21, 22 and 23. The inner tubular bodies 19*a* and 19*b* are fixed to the shaft 2 and a tube 24 for the passage of the wire 9 is fixed coaxially inside them.

An opening 25 is formed in the outer sleeve 18 and can be connected to a duct for supplying the pressurized fluid. An interspace 26 is formed between the outer sleeve 18 and the tube 24 and is connected to the opening 25. The duct 16 is provided with an inlet which is connected to the interspace 26 and is therefore fed constantly with the pressurized fluid despite the rotation of the tube 24 about the axis 2*a*.

It should be noted that at the ends of the groove 13 that lie proximate to the ends of the bow 1 it is possible to provide retention means which can be simply constituted by a choke in the groove 13 so as to close it around the wire 9. Said choke can be achieved directly by shaping the groove 13 or by arranging inside the groove 13, at its ends, perforated plugs which can be crossed by the wire 9.

Operation of the device according to the invention is as follows.

The wire 9 enters the tube 24 and from there, by passing through the shaft 2 and bending around the rotary guide 12, passes into the groove 13 formed on the side of the bow 1 that is directed toward the axis 2*a* and exits, in a per se known manner, from the other end of the bow 1.

During the operation of the stranding machine, the rotation of the bow 1 about the axis 2*a* generates a centrifugal force which pushes the wire 9 into the groove 13 toward the bottom of the groove 13.

The pressurized fluid, introduced in the groove 13 through the holes or the channel 14, contrasts the centrifugal force, reducing or even eliminating, depending on its supply pressure, which can be adjusted from outside, the effect of said centrifugal force on the wire 9. This significantly reduces the friction force that contrasts the advancement of the wire 9 along the bow 1 and the wire can be drawn, without problems, with a traction force which is lower than the maximum allowable traction force notwithstanding rotation rates of the bow 1 which are significantly higher than those attainable up to now in rotating-bow stranding machines.

Accordingly, the stranding machine equipped with the device according to the invention can achieve distinctly higher productivities than conventional stranding machines.

Merely by way of example, in a stranding machine equipped with the device according to the invention, by requiring the force generated by the pressurized fluid introduced in the channel 14 on the wire 9 to be equal to the centrifugal force that acts on said wire 9, one has:

$$p \cdot r \cdot dl = R(2\pi n)^2 \cdot m/l \cdot dl$$

where:

p=pressure of the fluid in the channel 14 r=part of the circumference of the wire struck by the pressurized fluid dl=infinitesimal portion of the wire 9 along the axis of the bow 1

R=distance of the point of the bow 1 being considered from the axis 2*a* n=rotation rate of the bow 1, in revolutions per second m/l=mass of the wire per unit length In a machine which has a bow whose distance from the axis 2*a* is variable from $R_{min}$=0.2 m (at the inlet of the wire 9) to $R_{max}$=0.25 m (at the point of the bow 1 that lies furthest from the axis 2*a*) and therefore with $R_{med}$=0.225 m, and which works with a wire having a diameter of 2 mm, assuming that one wishes to achieve a bow rotation rate of 3,000 rpm =5 revolutions per second, with a wire having a mass m=20 g on the length of the entire bow, equal to 0.75 m, and assuming an angle at the vertex of the groove 13=60° and therefore a portion of circumference of the wire struck by the fluid equal to r, one has a pressure applied to the wire by centrifugal force, as a function of R:

$$p=2.66 \cdot 10^6 \text{ R } (N/m^2)=26.2 \text{ R (atm)}$$

This means that its value is:

for $R_{min}$ p=5.32 atm for $R_{med}$ p=5.98 atm for $R_{max}$ p=6.65 atm

Therefore, if fluid is provided from outside at the maximum pressure of p=5.32 atm (which is the pressure that allows to limit the consumption of fluid, since it does not open the channel in any section of the bow 1), the pressure of the centrifugal force that is not counterbalanced varies from 0 (at $R_{min}$) to (6.65 −5.32)=1.32 atm (at $R_{max}$) therefore with an average value of 0.66 atm, which produces the following approximate total friction force (assuming a linear variation thereof):

$$F_a = f_a \cdot p \cdot l \cdot r = 0.25 \cdot 0.66 \cdot 10^5 \cdot 0.75 \cdot 10^{-3} = 12\,N$$

where:

$f_a$=friction coefficient=0.25 p=pressure of the centrifugal force that is not balanced l=length of the wire along the bow=0.75 m r=part of the circumference of the wire that is in contact with the track 13.

As can be noted, $F_a$ is well below the maximum traction stress $T_{max}$ that can be applied to the wire in order to pull it, which is 30 N.

Bearing in mind that centrifugal force increases with the square of the rotation rate of the bow 1, the maximum applicable traction force is reached at the speed that meets the relation:

$$n = 3{,}000\ \sqrt{(30/12)} = 3{,}670 \text{ rpm}$$

which allows to achieve highly competitive productivities.

In practice it has been observed that the method and the device according to the invention fully achieve the intended aim and objects, since by reducing the friction force of the wire-like element on the sliding track, for an equal traction applied to said wire, they allow to reach wire advancement speeds and stranding bow rotation rates, and therefore productivities, which are distinctly higher than in conventional machines.

Another advantage of the method and the device according to the invention, which again derives from the reduction of friction achieved along the bow of a stranding machine, is that the quality of the manufactured cable is improved. In stranding machines of the type with high friction on the bow, the adhesion of the wire to the face of the stranding bow, whose arrangement rotates through 360° at each turn of the bow, forces each section of the part that is contained in the first half of the bow to perform a complete rotation (twisting) with respect to each section of the portion of the fed wire that lies outside the machine (and is fixed to the ground) at each turn of the bow. Likewise, each section of wire contained in the second half of the bow is subjected to an opposite rotation (detwisting). There is the risk of leaving residual twisting, since twisting and detwisting might not compensate each other; but in any case the two alternated processes of twisting and detwisting in mutually opposite directions separate the outer layer of insulation from the central core of the conductor, degrading its electrical performance.

With the method and the device according to the invention, by fully or partly contrasting the effect of centrifugal force on the wire, the grip effect on the wire is eliminated and therefore so is the "crank" effect of the bow, which would produce the above-described twisting and detwisting.

It is thus possible to convert the operation of a bow machine (which typically involves twisting) into the operation of a so-called Skip or tubular machine (which is typically twist-free).

Although the method and the device according to the present invention have been conceived in particular to be adopted on stranding machines, they can in any case be used in other fields which likewise have the problem of facilitating the sliding, along a track, of an element having a predominant axial dimension which is subject to an intense force that compresses it against said track.

The method and the device thus conceived are susceptible of numerous modifications and variations, all of which are within the scope of the inventive concept; all the details may furthermore be replaced with other technically equivalent elements.

In practice, the materials used, as well as the dimensions, may be any according to requirements and to the state of the art.

The disclosures in Italian Patent Application No. MI99A002690 from which this application claims priority are incorporated herein by reference.

What is claimed is:

1. A method for facilitating sliding along a track of an element with a predominant axial dimension and subjected to an intense force pressing the element against the track, comprising the steps of:

providing said track in the form of a groove running along an advancement direction of said element and having a bottom and side walls which are shaped so that the groove widens gradually starting from said bottom thereof, said element contacting said side walls so as to form therewith a closed channel delimited by said bottom; and introducing pressurized fluid in said closed channel so that the fluid interposes between said element and said track and contrasts the force which presses said element against said track.

2. The method of claim 1, wherein said fluid introduction step comprises introducing said pressurized fluid in said channel through the bottom of said groove.

3. The method of claim 1, wherein said fluid introduction step comprises introducing said pressurized fluid in said channel through mutually spaced passages provided at the bottom of said groove.

4. The method of claim 1, wherein said fluid introduction step comprises introducing said pressurized fluid in said channel through a slot which runs continuously along said bottom of the groove.

5. The method of claim 1, further comprising the step of adjusting the pressure of the pressurized fluid introduced in said channel so as to act on said element with a force that is smaller than the force that compresses said element against said track.

6. The method of claim 1, further comprising the step of adjusting the pressure of the pressurized fluid introduced in said channel so as to act on said element with a force that is equal to force that compresses said element against said track.

7. The method of claim 1, further comprising the step of adjusting the pressure of the pressurized fluid introduced in said channel so as to act on said element with a force that is greater than the force that compresses said element against said track.

8. The method of claim 1, comprising the further step of using air as the pressurized fluid introduced in said channel.

9. The method according to claim 1, comprising the further step of using air mixed with a lubricant as the pressurized fluid introduced in said channel.

10. The method of claim 1, used for facilitating the sliding along a track of a wire subjected to stranding in stranding machines.

11. The method of claim 1, comprising the step of providing said groove that widens gradually starting from said bottom thereof with a cross-section shape being any of a U-shape and a V-shape.

12. A device for facilitating sliding along a track, of an element, having a predominant axial dimension and subjected to an intense force which presses the element against the track, comprising:

friction reduction means for reducing the sliding friction of said element of said track, which is provided along said track;

a groove, which lies along an advancement direction of said element so as to form said track, said groove having a bottom and side walls shaped so that the groove gradually widens starting from said bottom thereof; and a channel delimited by said side walls, by said element which contacts the side walls under the action of said pressing force, and by the bottom of said groove, said friction reduction means introducing pressurized fluid in said channel that interposes between said element and said track and contrasts the force which presses said element against said track.

13. The device of claim 12, wherein said friction reduction means comprises fluid conveyance means for conveying the pressurized fluid in said channel to contrast the force that presses said element against said track.

14. The device according to claim 13, wherein said fluid conveyance means comprises a duct supplied with a pressurized fluid and connected to the bottom of said groove.

15. The device according to claim 14, wherein said fluid conveyance means further comprises a plurality of fluid passages arranged spaced from each other along said groove to connect said duct to the bottom of the groove.

16. The device of claim 14, further comprising a rotary coupling which is connected to one of said shafts, and fluid feeding means for feeding pressurized fluid to said duct, said duct running partially inside said one of said coaxial shafts and being connected to said fluid feeding means through said rotary coupling.

17. The device according to claim 14, wherein said fluid conveyance means further comprises a slot which runs continuously along the bottom of said groove to connect said duct to said groove bottom.

18. The device of claim 12, wherein said track is located on a side of a stranding bow connected at ends thereof to two coaxial shafts of a stranding machine, the shafts being rotatable about a shaft axis, said bow side on which the track is located being directed toward the shaft rotation axis.

19. The device of claim 18, further comprising U-bolts for containing said element, said U-bolts being arranged along said bow side directed toward the shaft rotation axis, spaced from each other, and straddling said track so as to limit separation of said element from said track.

20. The device of claim 12, wherein said groove is provided so as to have any of a U-shaped and a V-shaped cross-section profile.

* * * * *